US005790999A

United States Patent [19]

Clark

[11] Patent Number: 5,790,999

[45] Date of Patent: Aug. 11, 1998

[54] NURSING PILLOW ADAPTED FOR USE WITH TWINS

[75] Inventor: Sandy L. Clark, 668 Mountain View Rd., El Cajon, Calif. 92021

[73] Assignee: Sandy L. Clark, El Cajon, Calif.

[21] Appl. No.: 842,667

[22] Filed: Apr. 15, 1997

Related U.S. Application Data

[60] Provisional application No. 60/015,446 Apr. 15, 1996.

[51] Int. Cl.[6] ..... A47C 20/00

[52] U.S. Cl. ..... 5/655; 5/657; 5/633

[58] Field of Search ..... 5/630, 632, 633, 5/635, 638, 655, 657, 655.9

[56] References Cited

U.S. PATENT DOCUMENTS 5,029,351 7/1991 Weber ..... 5/655
5,581,833 12/1996 Zenoff ..... 5/633 X
5,647,076 7/1997 Gearhart ..... 5/632 X
5,661,861 9/1997 Matthews ..... 5/655 X

*Primary Examiner*—Michael F. Trettel
*Attorney, Agent, or Firm*—Tom R. Arno, Knobbe Martens Olson & Bear LLP

[57] ABSTRACT

A nursing pillow adapted for use with twins that can be used by anyone wishing to breastfeed or bottlefeed one baby, or two babies simultaneously. The design of the nursing pillow is generally a squared U-shape with symmetrical sides of equal length and firmness to accommodate the heads and bodies of two babies at once. The pillow can support growing babies from birth to two-years-old, or up to 70 pounds of total baby weight. The nursing surface preferably has an inwardly-angled slope so babies roll naturally and safely towards the user. A detachable back pillow may be included to provide lower and mid-back support for the user.

13 Claims, 5 Drawing Sheets

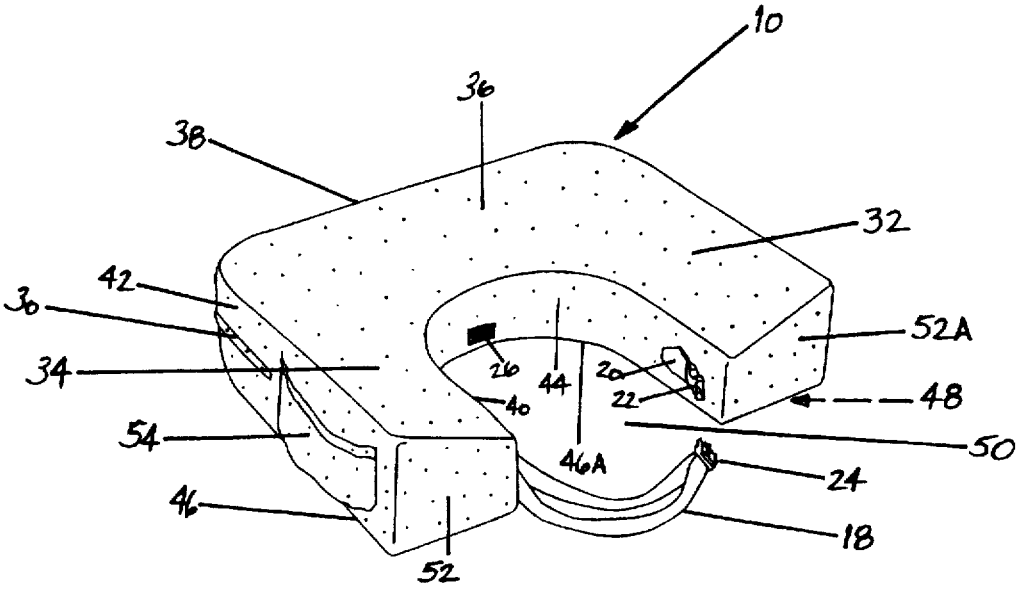
FIG. 4
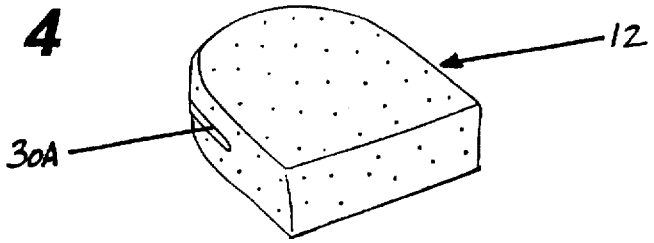
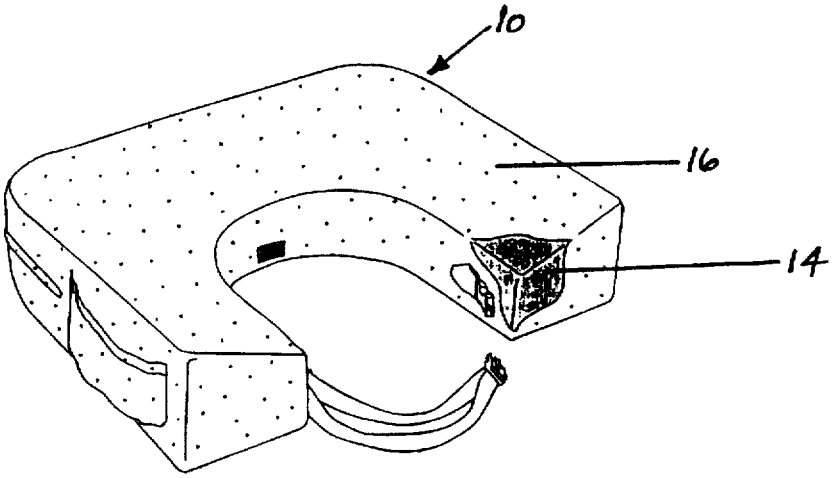
FIG. 5
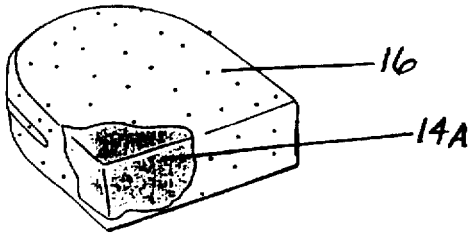

NURSING PILLOW ADAPTED FOR USE WITH TWINS

CROSS REFERENCES TO RELATED APPLICATIONS

This patent application claims priority under 35 U.S.C. 119(e) to U. S. Provisional patent application Ser. No. 60/015,446 filed Apr. 15, 1996 now abandoned. The disclosure of Provisional patent application Ser. No. 60/015,446 is hereby incorporated by reference in its entirety.

BACKGROUND—FIELD OF INVENTION

This invention relates to a pillow, specifically to an improved type of support pillow that allows breastfeeding or bottlefeeding one baby, or two babies simultaneously.

BACKGROUND—DESCRIPTION OF PRIOR ART

Most existing nursing pillows available today provide sufficient support for one baby and the arms of the nursing mother (or caregiver who is bottlefeeding) during the baby's first 12 months of life. Other pillows offer support specifically for a child or infant who is learning to sit up. However, very few can accommodate breastfeeding or bottlefeeding two babies simultaneously for two full years. Fewer still provide back support for the user of the pillow, and most importantly, none provide an inwardly-angled surface area which allows babies to naturally and safely roll towards the user.

Two pillows designed for support while nursing are described in U.S. Pat. No. 5,109,557 to Koy et al (May 05, 1992) and U.S. Pat. No. 4,731,890 to Roberts (Mar. 22, 1988). These pillows are generally L-shaped, forming a support surface for one infant and a user's arm. Neither pillow is designed to accommodate two babies at once nor do they address back support for the user.

U.S. Pat. No. 5,519,906 to Fanto-Chan (May 28, 1996) is described as a fastening support pillow that has a crescent shaped surface area. It can be used as a body support pillow by a child or adult, or as a nursing pillow for a reclining infant up to 20 pounds. Another pillow designed primarily for infant support is described in U.S. Pat. No. 5,261,134 to Matthews (Nov. 16, 1993). The upper and lower surfaces are rounded, resulting in a tubular shape. It is tapered at the ends and does not fasten to itself. But because of its size and shape, it does not lend itself to nursing two babies simultaneously. Neither of these two pillows have back support for the user.

A product advertisement in "Twins Magazine" (November/December 1996 issue) for the "Nurse Mate" pillow (offered by Four Dee Products of Stafford, Tex.) displays a C-shaped pillow with a flat surface area and fastening strap. Another product advertisement was seen in "New Beginnings" (La Leche League International, March/April 1997) for the "Nifty Nurser" pillow (offered by Sharie Fried of Valencia, Calif.). It displays a similar pillow to the "Nurse Mate", with a flat surface area and fastening strap. U.S. Pat. No. 5,154,649 to Pender (Oct. 13, 1992) offers an inflatable nursing pillow with multiple adjustable air chambers for customized support during nursing. The three pillows mentioned above provide a generally flat nursing surface and lack back support for the user.

Other nursing pillows focus on supporting the arm of the mother, which in turn supports the head and body of one baby, such as U.S. Pat. No. 5,133,098 to Weber (Jul. 28, 1992). This pillow is wedge-shaped to provide an inclined position for one baby laterally across mother's lap.

Two other pillows were cited that have recessed areas for the nursing infant. U.S. Pat. No. 5,551,109 to Tingley (Sep. 03, 1996) offers a pillow that the mother cradles in her arm which has a generally flat recessed surface area and overlapping straps which hold the infant in place. Also, U.S. Pat. No. 5,092,005 to Byrn (Mar. 03, 1992) provides a depression in the center of the pillow for the baby to lay within. However, the configuration and size of these pillows would not accommodate two babies and there is no back support pillow for the user.

U.S. Pat. No. 5,581,833 to Zenoff (Dec. 6, 1996) appears to be the only nursing pillow that has a lumbar support pad permanently affixed to the rear of the nursing pillow. However, the overall design is small and it has a flat surface.

All of the existing pillows described above suffer from a number of disadvantages:

(a) Most pillows focus on nursing or bottlefeeding only one baby at a time.

(b) Focus is also placed on supporting the user's arm, but they fail to address back, shoulder and neck strain.

(c) The size of the existing pillows appear to be, while some specifically state, accommodating newborns to 20 pounds. Few, if any, provide for mothers who wish to nurse their growing babies beyond that size.

(d) The top nursing surface of the existing pillows are typically tubular or flat. These designs require the user to utilize her hands and arms to keep the baby positioned on the pillow. Her hands are not free to tend to other activities, like positioning, caressing, burping or tending to a third child.

(e) Some of the existing pillows are L-shaped or crescent-shaped and fail to offer symmetrical dimensions on more than one or two sides.

(f) Several different means for fastening have been employed by some of the prior art pillows. Some use hook-and-loop with little room for accommodating users of varying sizes, and others lack a fastening device altogether.

OBJECTS AND ADVANTAGES

Accordingly, several objects and advantages of the present invention are to provide a pillow that will enable a user to breastfeed or bottlefeed not just one baby, but two babies simultaneously for up to two full years.

Breastfeeding one baby requires dedication and determination. However, breastfeeding, even bottlefeeding twins at the same time, requires twice the effort, plus an extra pair of hands to properly position the babies. Repetitive nursing of twins can cause arm, shoulder, neck, and back strain. Various devices have been proposed to support the arm of the mother which supports the baby, but few, if any, have been designed to support the heads and bodies of two babies at the same time, for up to two years, while also supporting the arms and back of the mother.

My nursing pillow emulates the natural way a baby is positioned when mother cradles him to her breast, his tummy-to-her tummy. By providing an inwardly-angled top surface on all three segments, the user enjoys equal support at the front and along both sides. The inwardly-angled design helps keep babies safely rolled toward mother, by virtue of the angle and gravity. This design is not only a safety feature, but it allows babies to nurse on their sides, facing mother, rather than flat on their backs with their heads turned to the side. Recent pediatric studies have suggested that improperly positioned nursing babies are prone to ear infections (because the breastmilk drains to the head rather than to the stomach), reflux problems and digestion disorders. Because both babies are rolled towards mother, she can nurse simultaneously without having her hands or arms under or around babies, as is necessary with many existing nursing pillows with rounded or flat surfaces. With the present invention, mother has full use of both of her hands to assist with latching-on (positioning baby's mouth to nipple), latch-release (releasing baby's suckle when finished or asleep), holding two bottles for simultaneous bottlefeeding, caressing, burping one baby while the one nurses or sleeps, or tending to a third child. Mothers of triplets and quadruplets can also benefit from using my pillow. A mother can nurse two babies, and with her free hands, bottlefeed one or two babies propped in infant seats. She can then rotate the bottlefed babies with the breastfed babies at subsequent feedings.

My nursing pillow also has the advantage of being one-size-fits-all, by providing the firmness and surface area needed to accommodate the heads and bodies of two babies from newborn size to two-years-old, or up to approximately 70 pounds of total baby weight. The symmetrical squared U-shape design can be worn around the torso of men (fathers who wish to help with bottlefeeding) and women of all sizes. The pillow has an adjustable strap, so that as the nursing mother looses weight during her postpartum months, it can be adjusted to stay snug around her torso. The strap is connected with a side-squeeze buckle, which makes on-and-off easy, secure and quiet (as compared to using hook-and-loop).

Another advantage is the detachable back pillow intended for the user, which is to be utilized in conjunction with the nursing pillow. None of the prior art pillows offer additional back support for the user, with the exception of Zenoff (U.S. Pat. No. 5,581,833 issued Dec. 16, 1996) which has a small, permanently affixed lumbar support pad. The present invention has a detachable back pillow which is firm, thick and vertically tall enough to provide lower as well as mid-back support. The nursing mother is able to relax against the back pillow, without pulling her breasts away from her suckling babies.

My nursing pillow's design and proportions also accommodate the body of an infant or child in a sitting-up position, prohibiting lateral movement because of its symmetrical design and equal height along the inside circumference. When a seated infant is placed in the opening of the pillow, with her feet extended out between the ends, she has an equal amount of firm padding on her back, left and right sides, preventing her from leaning or tilting sideways or backwards.

In summary, the objects of the present invention are:

(a) To provide a pillow that focuses on nursing or bottlefeeding one baby, or two babies at the same time.

(b) To provide a pillow that not only supports the user's arm and two babies, but includes a detachable back pillow for lower and mid-back support of the user.

(c) To provide a pillow that will support one or two babies up to two years, or up to 70 pounds of total baby weight.

(d) To provide a pillow with an inwardly-angled nursing surface so that babies can be positioned on their sides and remain naturally and safely rolled towards mother. This unique feature helps to alleviate the need to use her hands or arms to support the pillow, or the babies.

(e) To provide a pillow designed with proportional, symmetric dimensions on all three sides, which accommodates the head and body of one baby laterally across the front of the user, or the heads and bodies of two babies simultaneously, one positioned along each side of the user. This symmetry also prevents lateral movement when placed around a seated child and utilized as a body support pillow.

(f) To provide a secure, quiet and adjustable fastening system that will accommodate users of varying sizes. Still further objects and advantages will become apparent from a consideration of the ensuing description and accompanying drawings.

BRIEF DESCRIPTION OF THE DRAWINGS

FIG. 4 is an overall perspective of present invention, showing the inwardly-angled top nursing surface and squared-off corners of the nursing pillow, along with the detachable back pillow FIG. 5 is a perspective view of present invention, showing the outer cover removed from the inner foam core of both pieces

REFERENCE NUMERALS

Figure 1:
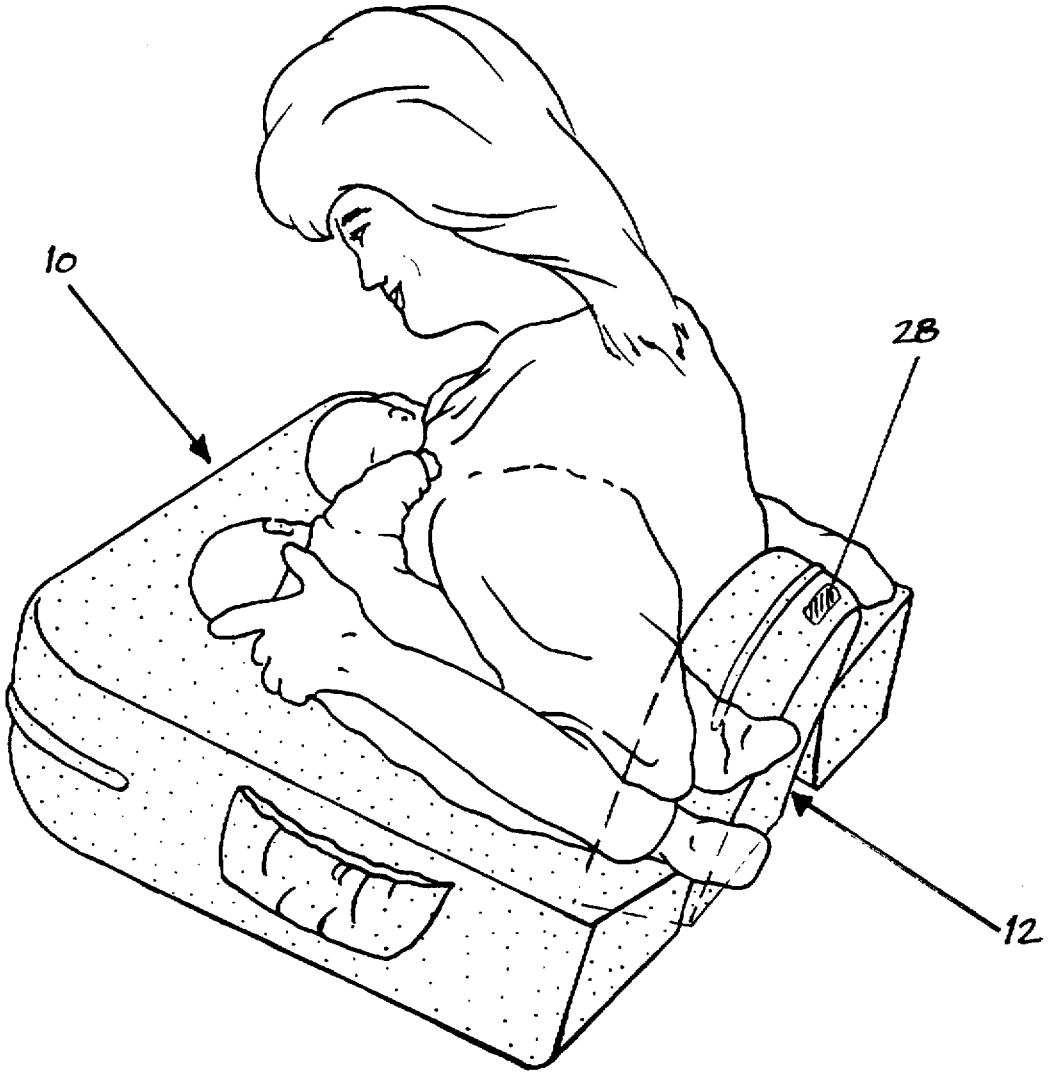
FIG. 1 shows a side perspective of a mother nursing two babies simultaneously utilizing the back pillow assembly in conjunction with the nursing pillow assembly

10 nursing pillow
12 back pillow
14 foam assembly
14A foam assembly
16 cover assembly
16A cover assembly
18 left strap
20 right strap
22 female buckle
24 male buckle
26 hook fastener
28 loop fastener
30 zipper
30A zipper
32 right arm segment
34 left arm segment
36 lateral arm segment
38 outer top edge
40 inner top edge
42 outer side wall
44 inner side wall
46 bottom edge
46A bottom edge
48 bottom surface
50 torso opening
52 blunt end 52A blunt end
54 pocket

SUMMARY

In accordance with the present invention a nursing pillow designed for the purpose of breastfeeding or bottlefeeding one baby, or two babies simultaneously. The pillow assembly may have a generally squared U-shape which secures around the user's torso with an adjustable strap and locking device. It is preferably constructed with sufficient firmness and dimensions to accommodate the heads and bodies of two babies when simultaneously feeding, for up to two years, or up to approximately 70 pounds of total baby weight. In some embodiments, the top surface has an inward-angle which allows the reclining babies to naturally and safely roll towards the user, emulating the natural way a mother and baby are positioned during breastfeeding. The pillow assembly may also include a detachable back pillow which provides lower and mid-back support for the user in conjunction with the nursing pillow. The pillow assembly can also be utilized as a sitting support for an infant or older child.

PREFERRED EMBODIMENT—DESCRIPTION

The invention will now be described with reference to the accompanying FIGS. 1–9, wherein like numerals refer to like elements throughout. The following description details certain preferred embodiments of the present invention. It must be appreciated, however, that no matter how detailed the foregoing appears in text, the invention can be practiced in many ways without departing from its essential spirit.

FIG. 1 shows a side perspective of my nursing support pillow in use and will be referred to as nursing pillow 10 and back pillow 12. This view demonstrates a typical application of a mother nursing two babies simultaneously, utilizing nursing pillow 10 in conjunction with back pillow 12, which provides support and comfort for her while nursing.

Figure 2:
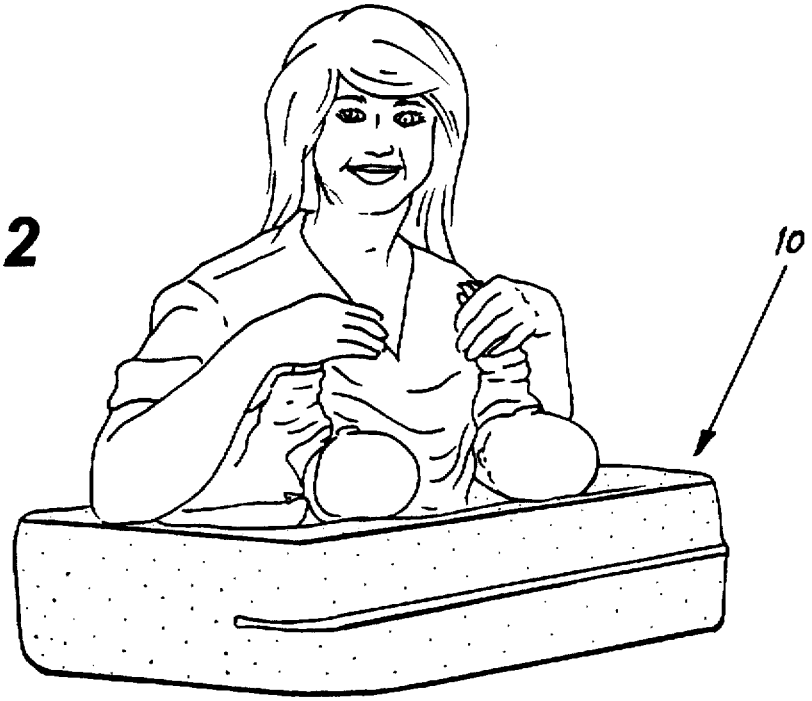
FIG. 2 shows a front perspective of a mother nursing two babies simultaneously using a preferred embodiment of present invention

FIG. 2 shows a front perspective of nursing pillow 10 in use nursing two babies simultaneously.

Figure 3:
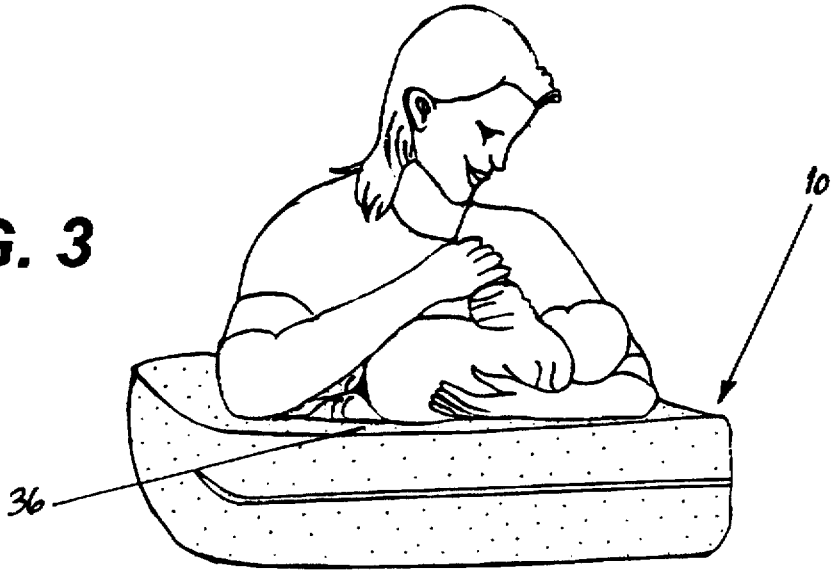
FIG. 3 shows a mother nursing one baby placed laterally across the front of present invention

FIG. 3 shows a front perspective of nursing pillow 10 in use nursing one baby placed transverse across lateral arm segment 36.

FIGS. 4–5 show a preferred embodiment of nursing pillow 10 and back pillow 12 according to one embodiment of the present invention. Nursing pillow 10 has a generally squared U-shape configuration. During manufacture, back pillow 12 is produced from remaining foam assembly 14A leaving behind a cut-out torso opening 50 of nursing pillow 10. Foam assembly 14 has a separate cover assembly 16 for nursing pillow 10 and another cover assembly 16A for back pillow 12. Cover assembly 16 for nursing pillow 10 has a left strap 18 wearing an adjustable sliding male buckle 24 that coordinates with a right strap 20 and a female buckle 22. The fastening device is preferably a side-squeeze type that provides a secure, yet simple, operating procedure for the user. Cover assembly 16 of nursing pillow 10 has a hook fastener 26 which matches with a loop fastener 28 (shown in FIG. 1) on cover assembly 16A of back pillow 12. This fastening means allows the user to insert back pillow 12 into nursing pillow 10 for storage when not in use. Nursing pillow 10 has a horizontally-placed zipper 30 so cover assembly 16 can easily be removed for laundering. As well, cover assembly 16A of back pillow 12 has a zipper 30A for the same purpose. Cover assembly 16 has a pocket 54 which provides a convenient storage space for necessities, such as a burp cloth, portable telephone, remote control or water bottle for the user. Both cover assemblies 16 and 16A are preferably made of a washable or waterproof fabric, suitable for home or commercial use.

Referring again to FIG. 4, nursing pillow 10, which forms a generally squared U-shape configuration, is comprised of a substantially linear right arm segment 32 and a substantially linear left arm segment 34 which lie perpendicular to, and are conjoined by, a substantially linear lateral arm segment 36. Right and left arm segments 32 and 34 are finished with vertical blunt ends 52 and 52A. This configuration forms a concise, symmetrical squared U-shape design. An outer top edge 38, which forms the squared U-shape outline around the perimeter of nursing pillow 10, defines the top of outer side wall 42. Outer top edge 38 joins inner top edge 40 which tapers, or angles inward, to an inner side wall 44. Outer side wall 42 has a greater vertical thickness than inner side wall 44. Outer side wall 42 bottom edge 46 and inner side wall 44 bottom edge 46A lie approximately in a common horizontal plane, creating a flat bottom surface 48 (shown in FIGS. 8–9). Nursing pillow 10 preferably measures approximately 26" wide along lateral arm segment 36, by approximately 22" long along right and left arm segments 32 and 34, by approximately 7" vertical height of outer side wall 42, by approximately 4" vertical height of inner side wall 44. Back pillow 12 measures approximately 4.5" thick by 11" wide by 14" tall. Although a variety of dimensions could be employed in some embodiments, these dimensions provide sufficient room for two nursing babies, ranging from newborn size to an average two-year-old, or up to approximately 70 pounds of total baby weight.

FIG. 5 is perspective view showing a portion of outer cover assembly 16 of nursing pillow 10 cut away from foam assembly 14. It also shows a portion of cover assembly 16A of back pillow 12 cut away from foam assembly 14A. In a preferred embodiment, foam assemblies 14 and 14A shall preferably be made of fire-retardant polyurethane foam, although any suitable material could be used. It is preferable, however, that whatever resilient material is utilized, the firmness be sufficient enough to support approximately 70 pounds of total baby weight.

Figure 6:
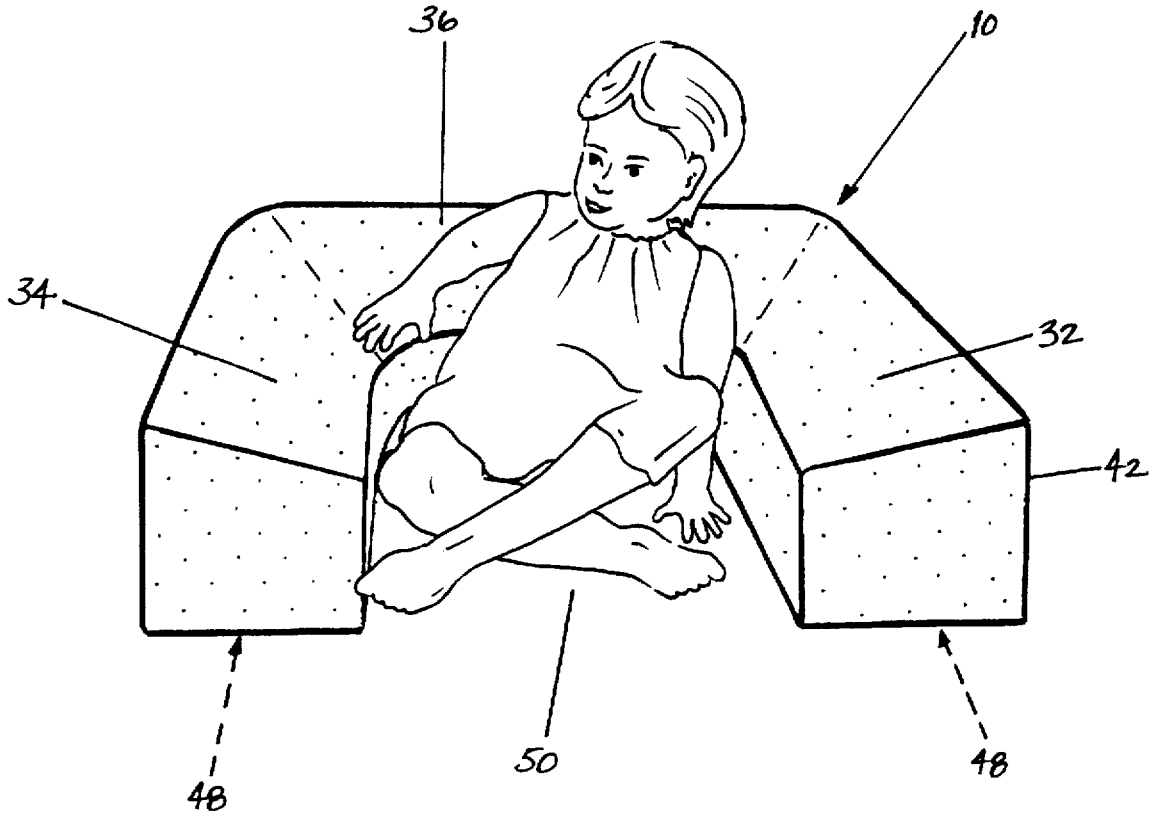
FIG. 6 shows a child utilizing invention for sitting support

FIG. 6 is a front plan view displaying a child sitting on a flat surface, utilizing nursing pillow 10 as a sitting support pillow. As a child learns to sit up, typically between birth and 12 months of age, she can sit within torso opening 50 and lean against inner side wall 44 of nursing pillow 10, which provides equal support of her back and each side. As displayed, outer side wall 42 has a greater vertical thickness than inner side wall 44, creating a inwardly-angled top surface of equal measure on all three segments 32, 34 and 36. Bottom surface 48 of all three segments 32, 34 and 36 is shown as a flat horizontal surface which provides the greatest possible stability for entire nursing pillow 10 assembly.

Figure 7:
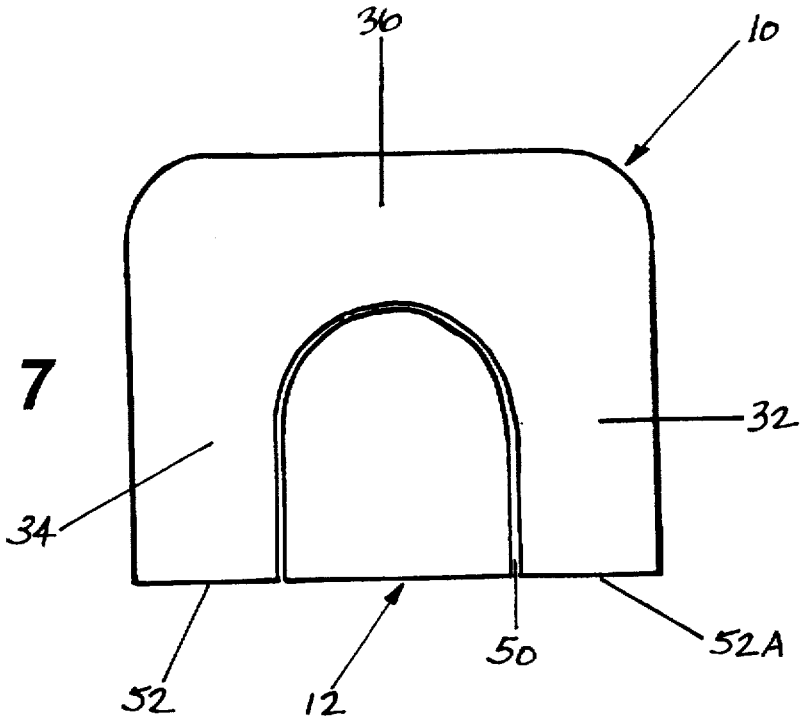
FIG. 7 is a top view of present invention, showing the back pillow assembly disposed inside the nursing pillow assembly

FIG. 7 is a top plan view of nursing pillow 10 and back pillow 12, whereby back pillow 12 is disposed within torso opening 50, showing the preferred symmetrical U-shape with slightly squared-off corners. This symmetry is formed by conjoining right arm segment 32 and left arm segment 34 with lateral arm segment 36. It also shows blunt ends 52 and 52A. This preferred embodiment allows for equal support of simultaneous nursing of two reclining babies.

Figure 8:
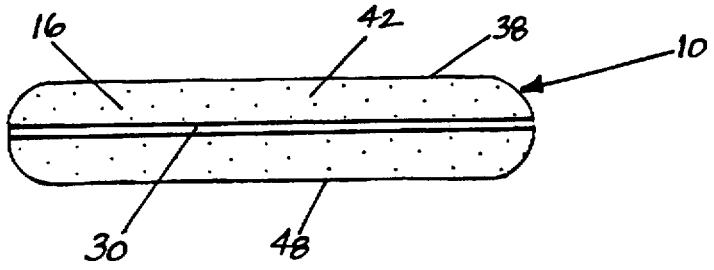
FIG. 8 is a rear view of present invention

FIG. 8 is a rear view showing cover assembly 16 of nursing pillow 10 with horizontally-placed zipper 30. This view also shows outer top edge 38, outer side wall 42 and generally flat bottom surface 48.

Figure 9:
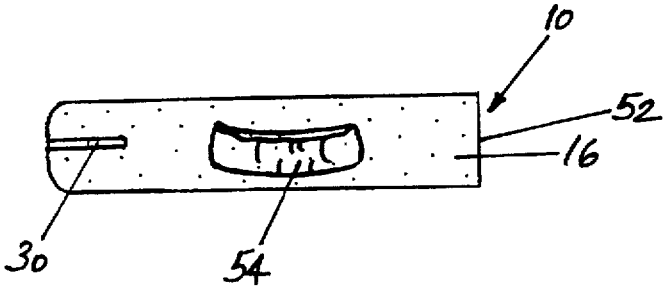
FIG. 9 is a side view of present invention

FIG. 9 is a side view showing the generally preferred placement of zipper 30 and pocket 54 of cover assembly 16.

It also shows blunt end 52 of the front vertical wall of nursing pillow 10.

PREFERRED EMBODIMENT—OPERATION

The use and operation of nursing pillow 10 and back pillow 12 will now be described detailing the best mode contemplated. Referring again to FIGS. 1 and 2, nursing pillow 10 is designed to fit around a user's waist while seated. Detachable back pillow 12 is removed from torso opening 50 of nursing pillow 10, which is temporarily attached there by means of hook and loop. With angled side up, user places nursing pillow 10 around her waist and, fastening left strap 18 and right strap 20 together by connecting side-squeeze buckles 22 and 24, adjusts a snug and secure fit. With babies within reaching distance, preferably one on her right side and one on her left side, she sits down between the babies on top of a bed, sofa or chair, and places back pillow 12 behind her, against bed headboard, sofa or chair back. Back pillow 12 is included to provide lower and mid-back support to the user. It assists in bringing the upper body forward so user can lean towards the babies, rather than hunch over them, relieving back, shoulder and neck strain. It also allows a mother to rest against a firm support while breastfeeding without pulling her nipples away from her nursing babies.

One of the most significant features of the present invention is the inwardly-angled top surface area of all three segments 32, 34 and 36 which comprise a generally squared U-shape configuration. In a preferred embodiment, the nursing mother of twins brings one baby to the top surface of right arm segment 32 of nursing pillow 10, and places him on his side in a reclining position towards her, and latches him onto her right breast. Once that baby is comfortably positioned and nursing, she slowly reaches to her left side and brings the second baby to the top surface of left arm segment 34, places him on his side in a reclining position towards her, and latches him onto her left breast. She is now breastfeeding two babies simultaneously in the "football hold" position, hands-free.

There are several benefits of the inwardly-angled top surface: it emulates the natural way a baby is positioned when brought to breast as in the natural "cradle hold" position, resting atop the inside bend of a mother's arm. The baby is positioned "tummy-to-tummy", baby's tummy to mother's tummy. The present invention provides that kind of positioning by creating an inwardly-angled top surface. The mother, particularly when wishing to nurse twins on a simultaneous feeding schedule, can single-handedly bring her babies to breast and have them fully supported in a most desirable position. Her hands are now free to assist with latching-on and latch-release, caressing their heads and backs, burping one baby while the other one is still nursing, or perhaps tending to a third child. Or, she can simply relax and rest her arms and shoulders atop nursing pillow 10 and relax her back against back pillow 12. Even mothers of triplets and quadruplets can benefit from the present invention by nursing two babies simultaneously, and with one or two free hands, bottlefeed the other babies. Another benefit of the inwardly-angled top surface is that of safety. Most existing nursing pillows have either a flat or rounded, toroidal shaped surface. The inwardly-angled top surface of the present invention assists the babies, when placed on their sides, with naturally and safely rolling towards the user and maintaining that position.

As shown in FIG. 3, the present invention can easily accommodate a single baby placed upon lateral arm segment 36 in a transverse position across the user's chest in the "cradle hold" position. The user can place her arm underneath the baby, so as to directly hold him, having her arm supported by the top surface, or she can lie the baby directly on the top surface. Here again, the baby enjoys a natural "tummy-to-tummy" position while the mother has her hands and arms free to attend to other activities, if necessary.

FIGS. 4–5 show the relationship of nursing pillow 10 to back pillow 12. During the manufacturing of the present invention, back pillow 12 is produced from remaining foam assembly 14A, leaving behind a cut-out torso opening 50 of nursing pillow 10. Two separate cover assemblies 16 and 16A are sewn to enclose foam assemblies 14 and 14A. There is a hook fastener 26 on cover assembly 16 that matches a loop fastener 28 of cover assembly 16A. These fasteners allow back pillow 12 to be temporarily attached inside nursing pillow 10 for storage, when not in use.

Both cover assemblies 16 and 16A are easily removable for laundering by opening zippers 30 and 30A, and removing foam assemblies 14 and 14A. Cover assemblies 16 and 16A can also be sewn of waterproof material for home or commercial use.

FIG. 6 shows another application utilizing the present invention. As a child learns to sit up during her first year, nursing pillow 10 can be placed around the child, so the child is positioned inside torso opening 50. She can then lean against inner side wall 44, which provides her with equal support of her back and each side. As with all the applications discussed previously, the support function and shape of nursing pillow 10 remains constant due to the firmness of foam assembly 14. Also, due to the flat bottom surface 48 of nursing pillow 10, shown in FIGS. 8–9, nursing pillow 10 will set securely and comfortably on any suitable flat surface, or comfortably on the user's lap.

CONCLUSIONS, RAMIFICATIONS, AND SCOPE

Accordingly, it can be seen that, according to the invention, I have provided a pillow that can accommodate breastfeeding or bottlefeeding one baby, or two babies simultaneously. The firmness of the foam assembly is of sufficient density, and the dimensions of the overall configuration are clearly ample, to support the head, back and bottoms of one, or two babies at the same time, from birth to two-years-old. The top surface of the nursing pillow has an inwardly-angled plane so that babies are in a natural position facing towards the user. The pillow secures around the waist of the user with an adjustable strap and fastening device, and a detachable back pillow is included for lower and mid-back support of the user. The covers enclosing the foam assemblies are easily removable and washable. The wider front, longer symmetrical sides, firmer foam, detachable back pillow and angled top surface are all aspects of preferred embodiments of the present invention that are improvements over the prior art nursing pillows.

Although the description above contains many specificities, these should not be construed as limiting the scope of the invention but as merely providing illustrations of some of the presently preferred embodiments of this invention. Various other embodiments and ramifications are possible within its scope.

For example, some of the articles used throughout the pillow could be substituted, namely zippers 30 and 30A, hook and loop fasteners 26 and 28, straps 18 and 20, or buckles 22 and 24, being replaced with snaps, buttons or other suitable fastening device, or any combination of the above. Pocket 54 could be larger or smaller, and placed somewhere else on nursing pillow 10, or even eliminated altogether.

An inner liner could be added to foam assembly 14 and 14A to provide additional waterproofing, or perhaps to cover assembly 16 and 16A itself. A plastic cover could be sealed firmly around foam assembly 14, enabling the pillow to float, if such an application were desired.

Foam assemblies 14 and 14A could be made with several different densities of foam, utilizing perhaps two different layers of foam, as long as the overall density could support up to approximately 70 pounds of total baby weight. The resilient material of foam assemblies 14 and 14A could also be something entirely different than foam, perhaps a fully washable material could be used so the entire pillow could be laundered. Additionally, the configuration of the square U-shape design could be manufactured as a retained compressible envelope and inflated with air.

The inwardly-angled surface of arm segments 32, 34 and 36 could be greater or less than 3 to 6 inches, although this angle has been found to be advantageous. The modular design of the U-shape could be manufactured separately in sections, then connected, rather than using a solid block of resilient material as suggested.

Back pillow 12 could vary in size and could be attached permanently to nursing pillow 10 or to straps 18 and 20, or it could be eliminated altogether, however, including some type of back support is preferred for the overall comfort of the user. The suggested squared U-shape design could be a different shape, as well, with perhaps more rounded corners or edges. It should be understood that the overall dimensions suggested can be varied to provide for say a small, medium and large size pillow. Thus, the scope of the invention should be determined by the appended claims and their equivalents, rather than by the examples given.

What is claimed is:

1. A nursing pillow to be worn around the waist of a user, designed to enable breastfeeding or bottlefeeding one, or two babies simultaneously, comprising an approximately U-shape form defining top and bottom surfaces, shaped to define an opening through which the user's waist fits, further comprising:

an outer side wall having a bottom edge and a top edge;

an inner side wall having a bottom edge and a top edge; and said top surface extending from said top edge of said outer side wall to said top edge of said inner side wall, wherein said outer side wall has an approximately constant vertical thickness which is greater than an approximately constant vertical thickness of said inner side wall so that said upper surface tapers downward toward the user, from said top edge of said outer side wall to said top edge of said inner side wall, so that as babies are reclining on said top surface of said pillow, their heads and bodies are adequately accommodated in a position facing towards the user's torso.

2. The nursing pillow of claim 1, wherein said outer side wall has a vertical thickness of approximately 6 to 9 inches.

3. The nursing pillow of claim 2, wherein said inner side wall has a vertical thickness of approximately 3 to 6 inches to allow for easy alignment of a baby's mouth when reclined, with a seated mother's breast.

4. The nursing pillow of claim 1 wherein said bottom edge of said outer side wall and said bottom edge of said inner side wall lie approximately in the same plane.

5. The nursing pillow of claim 1 wherein said top edge of said outer side wall defines a contour comprising a first approximately linear segment, a second approximately linear segment which is approximately parallel with said first segment, and a third approximately linear segment joining said first and said second approximately linear segments, said third approximately linear segment being approximately perpendicular to said first and said second approximately linear segments.

6. The nursing pillow of claim 5 wherein said top edge of said inner side wall defines a contour comprising a first approximately linear segment, a second approximately linear segment which is approximately parallel with said first segment, and a third approximately semicircular segment joining said first and said second segments.

7. The nursing pillow of claim 1, wherein said nursing pillow comprises a piece of resilient material having substantially the same firmness throughout.

8. The nursing pillow of claim 1, wherein said resilient material has a removable cover assembly configured to fully enclose said nursing pillow.

9. The nursing pillow of claim 8 wherein said cover assembly has an adjustable strap and fastening device for containing the user's torso within said nursing pillow.

10. The nursing pillow of claim 8 wherein said cover assembly includes a pocket.

11. A nursing pillow comprising three approximately linear segments of resilient material, wherein said three approximately linear segments of resilient material are coupled to form a generally squared U-shape configuration, thereby forming an inner opening adapted to fit around the torso of a nursing parent, wherein said nursing pillow comprises a top surface which slopes downward toward said inner opening along all three approximately linear segments of resilient material.

12. The nursing pillow of claim 13, wherein said generally squared U-shape configuration is formed with a single monolithic piece of resilient material.

13. A method of nursing an infant comprising the steps of:

removing a back-support from a back-support conforming cutout in a nursing pillow;

positioning said back-support behind a nursing parent's back;

positioning said nursing parent's torso into said cutout;

placing an infant onto a top surface of said nursing pillow so as to position said infant for nursing;

nursing said infant; and replacing said back support into said back-support conforming cutout prior to storing said nursing pillow.

* * * * *